US006471480B1

(12) United States Patent
Balkcum, III et al.

(10) Patent No.: US 6,471,480 B1
(45) Date of Patent: Oct. 29, 2002

(54) THIN WALLED COOLED HOLLOW TIP SHROUD

(75) Inventors: J. Tyson Balkcum, III, Taylors, SC (US); George Liang, Palm City, FL (US); Timothy J. Remley, Jupiter, FL (US); Christopher Charles Williams, Lake Worth, FL (US); Hans R. Przirembel, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/835,426

(22) Filed: Apr. 16, 2001

(51) Int. Cl.[7] ..... F01D 5/18

(52) U.S. Cl. ..... 416/97 R; 416/191; 416/233; 415/115

(58) Field of Search ..... 416/97 R, 191, 416/232, 233; 415/115

(56) References Cited

U.S. PATENT DOCUMENTS

| | | | | | |
|---|---|---|---|---|---|
| 4,127,358 | A | * | 11/1978 | Parkes | 416/97 R |
| 5,350,277 | A | * | 9/1994 | Jacala et al. | 416/90 R |
| 5,531,568 | A | * | 7/1996 | Broadhead | 416/97 R |
| 6,152,695 | A | * | 11/2000 | Fukue et al. | 416/97 R |
| 6,340,284 | B1 | * | 1/2002 | Beeck et al. | 415/115 |

* cited by examiner

*Primary Examiner*—Edward K. Look
*Assistant Examiner*—Ninh Nguyen
(74) *Attorney, Agent, or Firm*—Bachman & LaPointe, P.C.

(57) ABSTRACT

The present invention relates to a lightweight shrouded turbine blade. The turbine blade comprises an airfoil section and a hollow blade tip shroud joined to the airfoil section. The hollow tip shroud is preferably a cast, compartmentalized structure and has a plurality of ribs acting as load bearing structures and defining a plurality of shroud core sections. Each of the shroud core sections communicates with a supply of cooling fluid and has a plurality of apertures for supplying cooling fluid to exterior portions of the shroud.

9 Claims, 2 Drawing Sheets

THIN WALLED COOLED HOLLOW TIP SHROUD

BACKGROUND OF THE INVENTION

The present invention relates to a lightweight shrouded turbine blade for use in gas turbines having a thin walled cooled hollow tip shroud.

The use of shrouded gas turbine blades is known in the art. In these blades, the tip shroud of each blade is formed from a solid construction. As a result, the blades are quite heavy. Further, cooling of the tip shroud is very difficult.

SUMMARY OF THE INVENTION

It is an object of the present invention to provide a hollow, lightweight shrouded turbine blade.

It is a further object of the present invention to provide a turbine blade as above having an improved system for cooling the tip shroud.

The foregoing objects are attained by the shrouded turbine blade of the present invention.

In accordance with the present invention, a shrouded turbine blade comprises an airfoil section and a cored, hollow blade tip shroud joined to the airfoil section. The hollow tip shroud is preferably a cast structure and has a plurality of ribs acting as load bearing structures and defining a plurality of shroud core sections. Each of the shroud core sections communicates with a supply of cooling fluid and has a plurality of apertures for supplying cooling fluid to exterior portions of the shroud.

Other details of the lightweight shrouded turbine blade of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
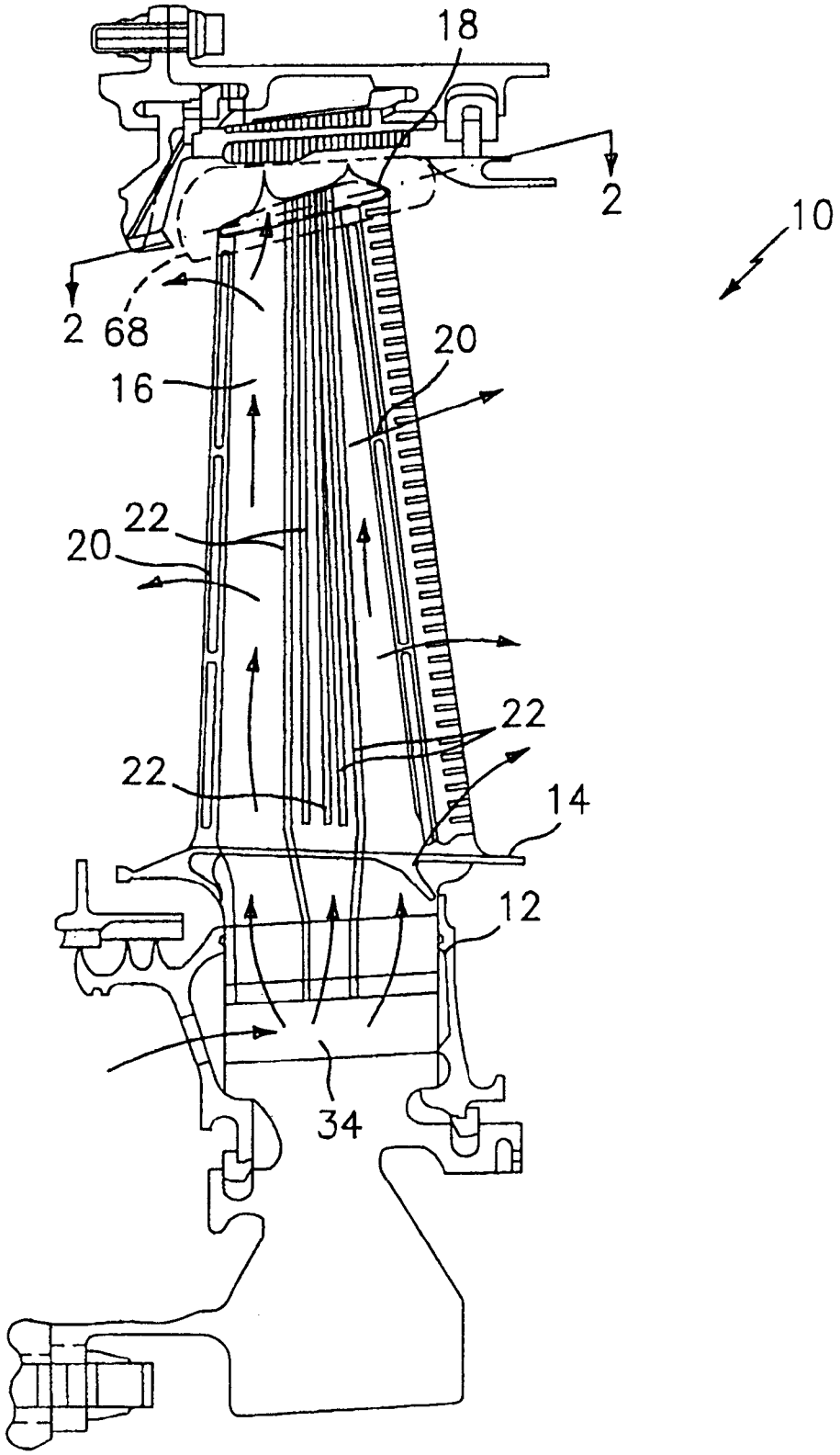
FIG. 1 is a sectional view of a turbine blade in accordance with the present invention having a hollow tip shroud.

Referring now to the drawings, FIG. 1 illustrates a shrouded turbine blade 10 in accordance with the present invention. The turbine blade 10 has a root portion 12, a platform 14, an airfoil section 16, and a hollow tip shroud 18 adjacent an end of the airfoil section 16. The airfoil section 16 has a plurality of cooling holes 20 by which a cooling fluid, such as air, is fed over surfaces of the airfoil section to cool same. The shroud 18 is preferably a cast, compartmentalized structure.

Figure 2:
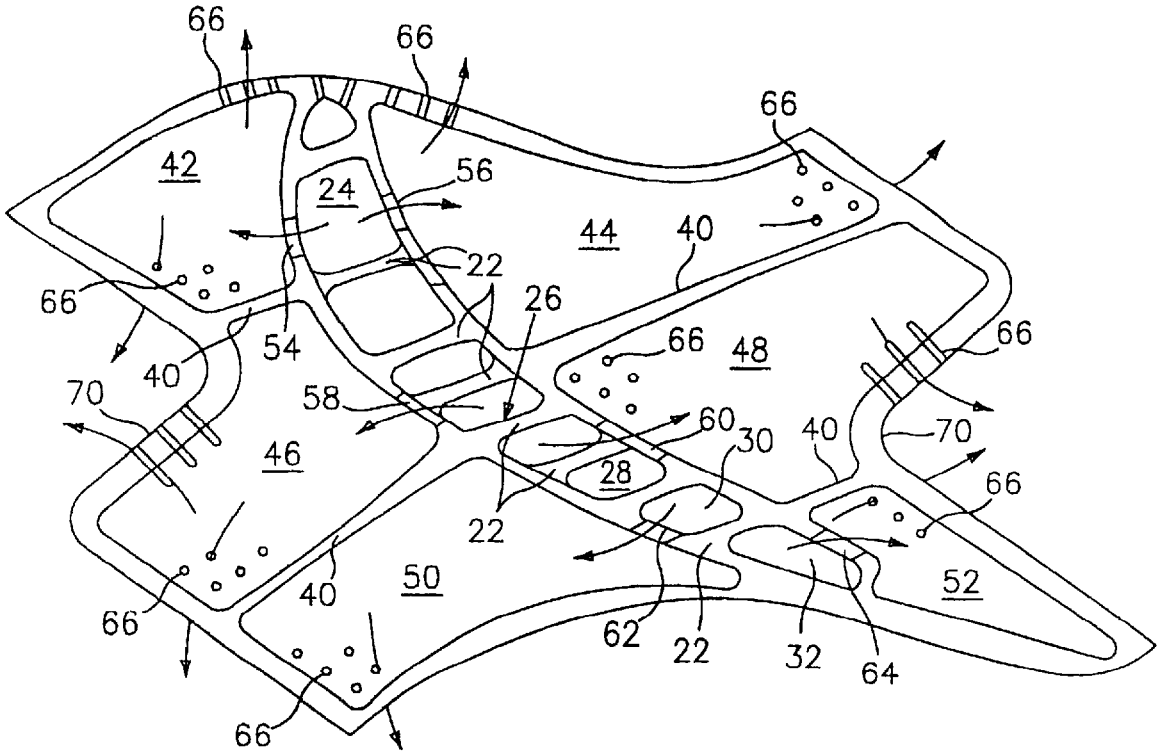
FIG. 2 is a sectional view of a hollow tip shroud taken along line 2—2 in FIG. 1.

As can be seen from FIGS. 1 and 2, a plurality of ribs 22 extend within the airfoil section 16 of the turbine blade 10 to the hollow tip shroud 18. The ribs 22 form a plurality of hollow airfoil core sections 24, 26, 28, 30, and 32. Each of the hollow core sections 24, 26, 28, 30, and 32 communicates with a passageway 34 through which cooling fluid flows from a source of cooling fluid (not shown). Each of the airfoil core sections 24, 26, 28, 30, and 32 acts as a cooling passageway and communicates with its own set of cooling holes 20. Some of the cooling fluid passing through the core sections 24, 26, 28, 30, and 32 exits via the cooling holes 20, while the remaining portion of the cooling fluid is transmitted to the hollow tip shroud 18.

Referring now to FIG. 2, the hollow tip shroud 18 has a compartmentalized structure in which a plurality of ribs 40 form a plurality of hollow shroud core sections or compartments 42, 44, 46, 48, 50, and 52. The ribs 40 act as load bearing structures.

Each of the shroud core sections 42, 44, 46, 48, 50, and 52 is in fluid communication with one of the airfoil core sections 24, 26, 28, 30, and 32 via at least one metering hole. For example, shroud core sections 42 and 44 communicate with airfoil core section 24 via metering holes 54 and 56. Similarly, shroud core section 46 communicates with airfoil core section 26 via metering hole 58, shroud core section 48 communicates with airfoil core section 28 via metering hole 60, shroud core section 50 communicates with airfoil core section 30 via metering hole 62, and shroud core section 52 communicates with airfoil core section 32 via metering hole 64.

While the present invention has been illustrated with just one metering hole between a respective shroud core section and an airfoil core section, it should be recognized that more than one metering hole can be used to place a respective shroud core section in fluid communication with a respective airfoil core section. Further, the amount of cooling fluid delivered from each respective airfoil core section to each respective shroud core section can be regulated by controlling the size and/or the density of the metering hole(s).

As can be seen from FIG. 2, each shroud core section is provided with a plurality of apertures or cooling holes 66. The size, shape, and density of the apertures or cooling holes 66 in each shroud core section may be varied to achieve one or more desired exterior surface cooling effects. For example, the apertures or cooling holes 66 may be designed to perform cooling of exterior portions of the shroud 18 by film, transpiration, localized impingement, and convection techniques. It can be said that the shroud core sections allow a great deal of cooling design flexibility.

The turbine blade design of the present invention provides numerous advantages. For example, the hollow tip shroud 18 is very efficient and provides the same strength as solid tip shrouds at a lower weight penalty. The reduced weight of the shroud 18 permits a lower stage airfoil count which leads to lower cost and a more robust blade. The rib geometry through the hollow shroud 18 act as load bearing structures that take the place of the traditional solid shroud geometry. Still further, because of the hollow shroud structure, the airfoil to shroud fillet 68 can be increased to reduce stress concentration with no increase in weight.

The localized compartments or shroud core sections in the shroud provide cooling design flexibility. Local airfoil and shroud metal temperatures can be tailored to the engine thermal environment by (1) a redistribution of coolant flow in each shroud core section or compartment, or (2) a change in metering hole size and/or density. Additionally, the cooling chamber compartmentalization provided by the shroud core sections minimizes the coolant flow demand that would normally be required by the large gas side pressure gradient. Still further, the compartmentalization in the shroud allows different compartments to be pressurized at different pressures and also allows cooling fluid to flow into and out of the compartments at different rates. The ribs forming the compartments prevent a continuous flow of fluid from the leading edge to the trailing edge of the shroud.

Other benefits provided by the present invention are that the shroud contact face 70 cooling through the cooling holes 66 in core sections 46 and 48 can be tailored and optimized for specific hardface materials, which is highly desirable since temperature drives a material's wear and extrusion characteristics. When used, film hole sizes in one or more of the shroud core sections are 40% smaller in diameter than plugging hole size limits. This is possible because cooling fluid exiting to the flowpath is contamination free due to particle centrifugation. The smaller film holes reduce overall cooling flow while maintaining cooling effectiveness.

Transpiration cooling may be utilized with the hollow shroud structure of the present invention to overcome the highly fluctuating velocity and pressure gradients existing on the hot flowpath side of the tip shroud. This cooling approach provides a very high cooling capacity and eliminates the need for extensive backside convection. This, in turn, simplifies the cooling configuration and reduces the shroud weight and subsequent airfoil load. The shroud structure of the present invention operates in a cooling fluid purged pocket behind a vane platform and attachment.

As can be seen from the foregoing discussion, there has been provided a lightweight shrouded turbine blade 10 that is cooled sufficiently to survive excessive turbine temperatures.

It is apparent that there has been provided in accordance with the present invention a thin walled cooled hollow tip shroud which fully satisfies the objects, means and advantages set forth hereinbefore. While the present invention has been described in the context of specific embodiments thereof, other variations, alternatives, and modifications will become apparent to those skilled in the art having read the foregoing description. Accordingly, it is intended to embrace those variations, alternatives, and modifications which fall within the broad scope of the appended claims.

What is claimed is:

1. A shrouded turbine blade comprising an airfoil section and a hollow blade tip shroud joined to said airfoil section, said shroud having a plurality of compartments, and said compartments having means for allowing a cooling fluid to flow through and over multiple external surfaces of said shroud.

2. A shrouded turbine blade according to claim 1, wherein said hollow blade tip shroud is a cast structure.

3. A shrouded turbine blade according to claim 1, wherein said hollow blade tip shroud has a plurality of ribs acting as load bearing structures and defining said compartments.

4. A shrouded turbine blade according to claim 3, further comprising means for supplying cooling fluid to each of said compartments and said cooling fluid allowing means comprising each of said compartments having at least one aperture for allowing said cooling fluid to flow over an exterior portion of said shroud.

5. A shrouded turbine blade according to claim 4, wherein said cooling fluid supplying means comprises means for supplying cooling air to said shroud core sections.

6. A shrouded turbine blade according to claim 4, further comprising said airfoil having a plurality of hollow airfoil core sections through which said cooling flows and each of said shroud core sections communicating with a respective one of said airfoil core sections via at least one metering hole.

7. A shrouded turbine blade comprising an airfoil section and a hollow blade tip shroud joined to said airfoil section, said shroud having a plurality of compartments, and each of said compartments having at least two apertures for allowing a cooling fluid to flow over an exterior portion of said shroud.

8. A shrouded turbine blade according to claim 7, further comprising an airfoil to shroud fillet for reducing stress concentration.

9. A shrouded turbine blade comprising:

an airfoil section and a hollow blade tip shroud joined to said airfoil section;

said hollow blade tip shroud having a plurality of ribs acting as load bearing structures and defining a plurality of hollow shroud core sections;

means for supplying cooling fluid to each of said shroud core sections and each of said shroud core sections having at least one aperture for allowing said cooling fluid to flow over an exterior portion of said shroud; and each of said shroud core sections having a plurality of apertures in a density sufficient to create a desired cooling effect.

* * * * *

UNITED STATES PATENT AND TRADEMARK OFFICE

CERTIFICATE OF CORRECTION

PATENT NO. : 6,471,480 B1 
DATED : October 29, 2002
INVENTOR(S) : J. Tyson Balkcum, III et al.

It is certified that error appears in the above-identified patent and that said Letters Patent is hereby corrected as shown below:

Column 1,
Line 3, after the title, a Government rights clause should be inserted as follows:

-- U.S. GOVERNMENT RIGHTS

The Government may have rights in this invention, pursuant to Contract No. N00019-97-C-0050, awarded by the United States Navy. --

Signed and Sealed this

Seventh Day of October, 2003

JAMES E. ROGAN
*Director of the United States Patent and Trademark Office*